US009999887B2

(12) United States Patent
Ettlin

(10) Patent No.: US 9,999,887 B2
(45) Date of Patent: Jun. 19, 2018

(54) APPARATUS FOR ANALYZING A TEST LIQUID

(71) Applicant: Sulzer Mixpac AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 154 days.

(21) Appl. No.: 15/117,589

(22) PCT Filed: Feb. 10, 2015

(86) PCT No.: PCT/EP2015/052689

§ 371 (c)(1),
(2) Date: Aug. 9, 2016

(87) PCT Pub. No.: WO2015/121214

PCT Pub. Date: Aug. 20, 2015

(65) Prior Publication Data

US 2016/0346779 A1 Dec. 1, 2016

(30) Foreign Application Priority Data

Feb. 11, 2014 (EP) ..... 14154738

(51) Int. Cl.
*B01L 3/00* (2006.01)

(52) U.S. Cl.
CPC ..... *B01L 3/5029* (2013.01); *B01L 2200/10* (2013.01); *B01L 2200/14* (2013.01);
(Continued)

(58) Field of Classification Search
CPC ..... A61B 10/0045; A61B 10/0051; A61B 10/007; B01L 2200/10; B01L 2300/0609;
(Continued)

(56) References Cited

U.S. PATENT DOCUMENTS 5,238,649 A 8/1993 Nason
5,266,266 A 11/1993 Nason
(Continued)

OTHER PUBLICATIONS

International Search Report dated May 8, 2015 in International Application No. PCT/EP2015/052689, filed Feb. 10, 2015.
(Continued)

*Primary Examiner* — Sally A Merkling
(74) *Attorney, Agent, or Firm* — Global IP Counselors, LLP

(57) ABSTRACT

An apparatus for a test liquid includes an inlet device defining a chamber configured to receive the liquid, a preparation device defining a preparation chamber and including a preparation reagent to be reacted with the liquid, an analysis device defining an exposure chamber associated with the preparation chamber and including an analysis unit to be exposed to the prepared test liquid for indicating information on the test liquid, a housing defining a longitudinal axis, and a guiding device configured to guide the inlet device, the preparation device or the analysis device so as to limit the motion of the inlet device, the preparation device or the analysis device to a sequence of alternating rotational and axial movements, each axial movement of the inlet device, the preparation device or the analysis device requiring activation through a preceding rotational movement of the inlet device, the preparation device or the analysis device.

25 Claims, 3 Drawing Sheets

(52) U.S. Cl.
CPC ..... *B01L 2200/141* (2013.01); *B01L 2200/16* (2013.01); *B01L 2300/087* (2013.01); *B01L 2300/0832* (2013.01); *B01L 2400/0683* (2013.01)

(58) Field of Classification Search
CPC ..... B01L 2300/0663; B01L 2300/0672; B01L 2300/069; B01L 2400/0475; B01L 2400/0478; B01L 2400/049; B01L 3/5023; B01L 3/5029
See application file for complete search history.

(56) References Cited

U.S. PATENT DOCUMENTS

| | | | | |
|---|---|---|---|---|
| 2002/0001539 | A1 | 1/2002 | DiCesare et al. | |
| 2008/0206740 | A1 | 8/2008 | Skiffington et al. | |
| 2013/0316335 | A1 | 11/2013 | Ross et al. | |
| 2014/0004548 | A1* | 1/2014 | Gordon ..... | B01L 3/5029 435/21 |

OTHER PUBLICATIONS

International Preliminary Report on Patentability and Written Opinion dated Aug. 16, 2016 in International Application No. PCT/EP2015/052689, filed Feb. 10, 2015.

* cited by examiner

APPARATUS FOR ANALYZING A TEST LIQUID

CROSS-REFERENCE APPLICATION

This application is a U.S. National Stage Application of International Application No. PCT/EP2015/052689, filed Feb. 10, 2015, which claims priority to European Application No. 14154738.0, filed Feb. 11, 2014, the contents of each of which is hereby incorporated herein by reference.

BACKGROUND

Field of Invention

The present disclosure relates to an apparatus for analyzing a test liquid, in particular to a portable and hand-held analyzing apparatus. The present disclosure also relates to a preparation container for an analyzing apparatus as disclosed herein. Further, the present disclosure relates to a use of an analyzing apparatus as disclosed herein.

Background Information

Generally, analyzing devices are known which can be used, for example, for analyzing urine samples or salvia samples. Such devices may be utilized in the medical field, e.g. for conducting rapid tests such as drug tests. However, the use of analyzing devices is not limited to the medical field. In certain appliances it may be desired to verify the existence of one or more chemicals or chemical products in a test sample.

In practice, it is often desired to analyze a non-liquid sample such as a sample substance which is in the form of a solid. In order to provide a test liquid which can easily be analyzed with an analyzing apparatus, the sample may be mixed with a so-called washing-out liquid or the sample may be dissolved in a diluent. Further, in order to actually analyze the test liquid, it is often necessary to prepare the test liquid with a suitable reagent.

The handling of existing analyzing devices is often complicated, especially if it is desired to make use of a washing-out liquid or of a diluent in order to provide a liquid test medium and if a preparation of the test medium is required.

SUMMARY

Before this background, one object of the present disclosure is to provide an apparatus for analyzing a test liquid which enables an easy and reliable usage, in particular for analyzing non-liquid samples, i.e. for appliances in which it is required to use a washing-out liquid or a diluent and/or in which a preparation of a test medium is necessary.

The present disclosure provides such an analyzing apparatus as well as a container for the analyzing apparatus.

Accordingly, one aspect of the present disclosure relates to an apparatus for analyzing a test liquid, comprising an inlet device defining at least one inlet chamber adapted to receive the test liquid, comprising a preparation device defining at least one preparation chamber associated with the inlet chamber and including at least one preparation reagent to be reacted with the test liquid for preparing the test liquid, comprising an analysis device defining at least one exposure chamber associated with the preparation chamber and including an analysis means or device to be exposed to the prepared test liquid for indicating information on the test liquid, comprising a housing defining a longitudinal axis and having a proximal end and a distal end, wherein inside the housing the inlet device is located proximal to the preparation device and the preparation device is located proximal to the analysis device, wherein the inlet device is movable relative to the housing along the longitudinal axis towards the preparation device from a starting position, defining a starting condition of the apparatus, into a preparation position for establishing a flow connection for the test liquid from the inlet chamber to the preparation chamber in a preparation condition of the apparatus, and wherein subsequently the inlet device and the preparation device are jointly movable relative to the housing along the longitudinal axis towards the analysis device from the preparation position into an analysis position for establishing a flow connection for the prepared test liquid from the preparation chamber to the exposure chamber in an analysis condition of the apparatus, and comprising a guiding means or device adapted to guide at least one of the devices so as to limit the motion of that at least one device to a sequence of alternating rotational and axial movements, each axial movement of the at least one device requiring activation through a preceding rotational movement of that at least one device.

According to another aspect of the present disclosure, a preparation container is provided, the preparation container being adapted to be loaded into the housing of the analyzing apparatus so as to form the preparation device of the apparatus.

According to a further aspect, the present disclosure provides a use of an apparatus as disclosed herein for conducting chemical rapid tests or drug rapid tests.

The concept of the present disclosure is to change the condition of the analyzing apparatus from a starting condition via a preparation condition to an analysis condition by a sequence of alternating rotational and axial movements. This sequence is controlled by a guiding means or device so as to ensure that an axial movement into the next condition is only allowed after a rotational movement. Thus, a strict concept of "rotating before pushing" is applied. Operational errors are thereby avoided.

In practice, it is often required to wait a certain amount of time before the next condition of the analyzing apparatus is established. The strict concept of "rotating before pushing" of the present disclosure helps preventing the next step of the analyzing procedure from being performed too early. In one appliance, for example, it may be required to have the test liquid reacted with the preparation reagent for a couple of minutes before the analysis device can be exposed to the so prepared test liquid.

In one example, the preparation reagent is in the form of gold conjugate. Following the preparation of the test liquid with this gold conjugate, the prepared test liquid can be brought into contact with the analysis device which, for example, can be in the form of an analysis strip. The prepared test liquid gets into contact with this strip at one end thereof and then flows through the strip so as to change the condition, in particular the color, of the strip depending on the contents of the test liquid. For example by visual inspection of the exposed analysis strip, the user is easily and rapidly provided with the analysis results.

The preparation container may be in the form of a capsule or a cartridge. The preparation container is adapted to be loaded into the housing of the apparatus so that the preparation device of the analyzing apparatus is in the form of a separate component which may be produced, distributed and/or offered for sale separately from the remaining components of the analyzing apparatus.

In an embodiment, the preparation reagent is in the form of a solid body carried by the preparation container and being in fluidic contact with the preparation chamber. In an alternative embodiment, the preparation reagent is a fluid, in particular a liquid, contained in the preparation chamber of the container.

The components of the analyzing apparatus and/or the preparation container may be fabricated from any suitable material. In one embodiment, at least some of the components are made from plastic material. The material may be selected from the group comprising PP, COC, PE, PA, PBT and PMMA. Alternatively, the material may be glass, metal or an alloy.

Preferably, the dimensions of the analyzing apparatus are made such that the apparatus may be utilized as a portable and hand-held device allowing for an easy and simple use in the field. Advantageously, large quantities of analyzing apparatuses may be taken along and made use of by one single person.

In one embodiment, the apparatus is adapted such that a test liquid, which is ready to be prepared by the preparation reagent, can be introduced in a suitable manner into the inlet chamber of the inlet device.

In an alternative embodiment, a basic chamber is provided inside the housing, the basic chamber containing or being adapted to receive a basic fluid, in particular a diluent, to be transferred into the inlet chamber of the inlet device in use of the apparatus. This embodiment enables the introduction of a non-liquid sample into the inlet chamber and a washing-out of the sample or a dissolving of the sample by the basic fluid. Specifically, the sample may be mixed with the basic fluid or may be dissolved in the basic fluid so as to provide the test liquid.

For introducing the sample into the inlet chamber, a sample collector, which in particular forms a constituent of the analyzing apparatus, may be provided.

An activation means or device may be provided for establishing a flow connection for the basic fluid from the basic chamber to the inlet chamber before moving the inlet device towards the preparation device.

In one embodiment, the inlet device has a wall confining the inlet chamber, the wall having a circumferential portion in which at least one hole is disposed so as to allow the basic fluid to flow from the basic chamber through the hole into the inlet chamber.

According to one embodiment of the present disclosure, the inlet device is movable relative to the housing along the longitudinal axis from an initial position, defining an initial condition of the apparatus, into the starting position, the activation device being adapted to establish the flow connection for the basic fluid when the inlet device is in the starting position or is being moved towards the starting position.

In the initial condition, the inlet device may be located proximal to its position in the starting condition of the apparatus. Alternatively, the starting condition may be established by rotating the inlet device relative to the housing without moving the inlet device in an axial direction.

In one embodiment, the basic chamber for the basic fluid may be defined by the housing, or may be defined by the housing and one or more portions of one or more of the other components of the apparatus.

In an alternative embodiment, the apparatus further comprises a basic device defining a basic chamber, the basic device being axially arranged between the inlet device and the preparation device, wherein, successively, the inlet device is movable from an initial position into the starting position, the inlet device and the basic device are jointly movable from the starting position into the preparation position, and the inlet device, the basic device and the preparation device are jointly movable from the preparation position into the analysis position.

According to the present disclosure, it is possible that only one of the devices of the apparatus is actually guided by the guiding device. In an alternative embodiment, the guiding device is adapted to guide the inlet device, the basic device as well as the preparation device.

In an embodiment, the inlet device, the basic device and the preparation device are adapted to be successively nested into each other coaxially with respect to the longitudinal axis as the apparatus changes its condition.

This concept offers the possibility to establish a very compact design, thereby reducing the outer dimensions of the housing to a minimum and in particular facilitating the use even of large quantities of the apparatus in the field.

In particular, the inlet device and the preparation device may be slid at least partially into the inlet device from different ends thereof.

In an embodiment, the apparatus further comprises a coupling means or device associated with jointly movable ones of the devices and adapted to rotationally fixedly couple jointly movable devices to each other in a joined state, so as to effect activation of the axial movement of a distal one of the joined devices through a rotational movement of a proximal one of the joined devices.

In this embodiment, it is not necessary to rotate each device individually. Rather, rotation of one of the devices, in particular of the inlet device, automatically rotates all devices coupled, either directly or indirectly, to the inlet device.

In an embodiment, the coupling device is adapted to be enabled by moving the respective proximal device along the longitudinal axis of the housing towards the respective distal device, in particular into axial contact with the respective distal device. In this embodiment, changing the condition of the apparatus at the same time couples the next device.

In particular, the coupling device comprises at least one coupling element formed at the respective proximal device and at least one coupling element formed at the respective distal device, the coupling elements being adapted to engage with each other so as to establish a circumferentially form-locked connection. In an embodiment, the coupling device comprises at least one pair consisting of an axial protrusion at the one device and a complementary cut-out at the other device.

In an embodiment, enabling of the coupling device is automatically controlled by the guiding device. In this embodiment, the guiding device not only provides for defined rotational and axial movements of the individual devices but also guide the devices in a manner such that the devices are automatically coupled to each other.

In an embodiment, the guiding device is adapted to provide resistance to a rotational movement of the at least one device. The resistance may be dimensioned such that it can be clearly felt by a user so that unintentional rotation of a device is prevented, thereby avoiding an accidental change of condition of the apparatus.

In an embodiment, the guiding device comprises at least one slot cooperating with at least one pin. In particular, the pin is formed at the at least one device and the slot is arranged stationary with respect to the housing.

The guiding device may comprise at least one separate guide component, wherein in particular the housing has a wall, the guide component being arranged inside the housing between the at least one device and the wall of the housing, thereby at least partially enclosing the at least one device.

In an embodiment, a distal portion of the guiding device forms at least a part of the analysis device. In particular, the distal portion defines at least a part of the exposure chamber and/or of a carrier or reception for the analysis device. In this embodiment, the number of parts of the apparatus may be reduced by using the guiding device not only for guiding at least one of the devices but also at least partially forming the analysis device.

The guide component may generally have the shape of a hollow cylinder enclosing the at least one device at least partially. In an embodiment, the guide component is a multi-part component, thereby facilitating the assembly of the apparatus. In particular, the guide component may comprise two half-shells being connected to each other and/or being connected to a wall of the housing.

In an embodiment, if the guide component comprises at least two parts, for example two half-shells, at least the inlet device and the preparation device may be received within a space defined by the at least two parts of the guide component. The at least two parts of the guide components, the inlet device and the preparation device thereby form a sub-assembly which is received within the housing and which, on assembly of the analyzing apparatus, is adapted to be inserted into the housing, in particular through an insertion opening defined at the proximal end of the housing.

The inlet device may have a proximal end which defines an inlet opening, the inlet chamber of the inlet device being accessible through the inlet opening. In particular, a closure is provided which is adapted to close the inlet opening. In an embodiment, the inlet device and the closure are adapted to cooperate so as to enable the inlet device to be rotated by the closure.

In an embodiment, the apparatus further comprises a sample collector adapted to be introduced into the inlet chamber of the inlet device, in particular to a proximal inlet opening of the inlet device.

Using the collector, for example a urine sample or a salvia sample may be introduced into the inlet chamber in an easy manner.

The sample collector may be mounted at a distal end of an elongate support adapted to be manually held by a user. In particular, the support includes a closure for closing a proximal inlet opening of the inlet device and/or a proximal insertion opening of the housing.

In order to avoid detrimental leakage of test liquid out of the inlet chamber, the sample collector may comprise a plug member which is adapted to be sealingly fitted into the inlet device so as to proximally close off the inlet chamber in a fluid-tight manner.

In an embodiment, the inlet device has a distal end defining a distal opening allowing access to the inlet chamber and being adapted to receive the preparation device in the preparation position of the inlet device.

In the starting position of the inlet device, the distal opening may be closed by a breakable seal.

The preparation device may include an activation means or device for establishing the flow connection for the test liquid from the inlet chamber to the preparation chamber. In particular, the activation device includes a means or device for breaking a seal, in particular for piercing, penetrating, puncturing and/or perforating the seal.

In the preparation position of the inlet device, the preparation device may be sealingly fitted into the inlet device so as to locate the preparation chamber within the inlet chamber.

In an embodiment, the preparation device has a wall confining the preparation chamber, the wall having a circumferential portion in which at least one hole is disposed so as to allow the test liquid to flow from the inlet chamber through the hole into the preparation chamber. The preparation device may comprise a separate container, in particular in the form of a capsule or cartridge, including the preparation chamber and the preparation reagent, the container being loaded or being adapted to be loaded into the housing.

In an embodiment, the preparation reagent is in the form of a solid body carried by the preparation device and being in fluidic contact with the preparation chamber. Alternatively, the preparation reagent may be a fluid, in particular a liquid, which is contained in the preparation chamber.

In an embodiment, the preparation device has a distal end defining a distal opening allowing access to the preparation chamber and adapted to receive, in the analysis position, the analysis device so as to expose the analysis device inside the exposure chamber of the analysis device to the prepared test liquid contained in the preparation chamber.

In the preparation position of the preparation device, the distal opening may be closed by a breakable seal.

The analysis device may include an activation means or device for establishing the flow connection for a prepared test liquid from the preparation chamber to the exposure chamber. In particular, the activation device includes a means or device for breaking a seal, in particular for piercing, penetrating, puncturing and/or perforating the seal.

In order to provide the user with information concerning the momentary or the next condition of the apparatus, in an embodiment the housing has a wall, a circumferential portion of the wall including at least one window allowing an outer surface of at least one of the devices to be viewed from outside the housing, the outer surface of the at least one device including a plurality of indications, for example descriptions and/or symbols, successively aligned with the window as the apparatus changes its condition, each indication—if aligned with the window—indicating a respective one of the conditions of the apparatus In an embodiment, the outer surface, which includes the indications, is the outer surface of the basic device.

In an embodiment, the guiding device includes at least one window as well, the window of the guiding device being aligned with the window of the housing.

In another aspect, the present disclosure also relates to the use of an apparatus as disclosed herein for conducting chemical rapid tests or drug rapid tests by exposing at least one analysis device, contained within the apparatus, to the test liquid or to a prepared test liquid obtained by reacting, inside the apparatus, at least one preparation reagent, included within the apparatus, with a test liquid.

In use, the test liquid may be filled into the apparatus or may be obtained by introducing a test sample into the apparatus and dissolving or mixing, inside the apparatus, the test sample in or with a basic fluid contained within the apparatus.

Further embodiments of the present disclosure are also indicated in the description, in the claims as well as in the drawings.

The different embodiments of the analyzing apparatus and the preparation container described above as well as the individual features which are disclosed there and/or which are mentioned in the dependent claims may be combined with each other.

BRIEF DESCRIPTION OF THE DRAWINGS

The invention will be explained in more detail hereinafter with reference to the drawings.

DETAILED DESCRIPTION OF THE EMBODIMENTS

In the embodiment shown in FIGS. 1 to 8, the analyzing apparatus comprises a generally cylindrical housing 91 having a closed distal end and a proximal insertion opening 92.

Figure 2:
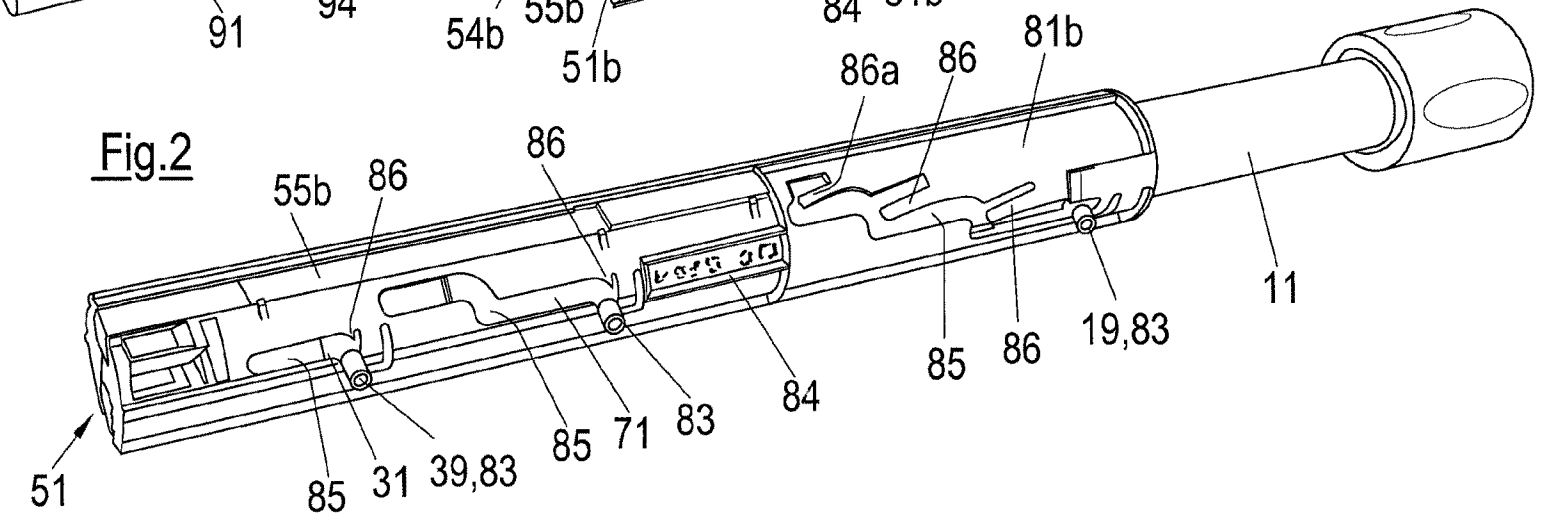
FIG. 2 shows the apparatus of FIG. 1 in the assembled state without the housing.

The other components of the apparatus, which are described in the following, can be assembled to form a sub-assembly as shown in FIG. 2. This sub-assembly can be inserted into the housing 91 through the insertion opening 92.

The apparatus further comprises a generally cylindrical inlet device 11 having a distal end which is closed by a breakable seal 21 in the form of a foil. The inlet device 11 has a proximal opening through which a sample collector 95 may be introduced in order to place the sample collector 95 in an inlet chamber 13 (FIG. 5) defined inside the inlet device 11.

The sample collector 95 is mounted to the distal end of an elongate support 97 which is disposed at its proximal end with a closure 93 adapted to be grasped by a user.

The elongate support 97 is disposed, near the proximal end of the sample collector 95, with a plug member 99 in the form of a collar. The diameter of the plug member 99 corresponds to the inner diameter of a distal cylindrical portion of the inlet device 11.

The proximal end of a proximal cylindrical portion of the inlet device 11 includes a thickened coupling portion 14 defining a non-circular outer face to be coupled with a complementary inner face of the closure 93. This enables the user to rotate the inlet device 11 by rotating the closure 93.

The apparatus further comprises a generally cylindrical basic device 71 having a proximal opening allowing the distal cylindrical portion of the inlet device 11 to be inserted into the basic device 71. Into a distal opening of the inlet device 11, a preparation container 31 may be inserted with a proximal cylindrical portion 31*a*. The preparation container 31 will be described in more detail with reference to FIG. 4.

The apparatus further comprises a guiding means or device comprising two half shells 81*a*, 81*b* adapted to accommodate the preparation container 31 and the basic device 71 in the assembled state in which the half shells 81*a*, 81*b* form a cylinder which is closed at the distal end and which has a proximal opening so as to allow the inlet device 11 to be slid into the proximal opening of the basic device 71.

Each half shell 81*a*, 81*b* has a distal portion forming a part 51*a*, 51*b* of an analysis device 51. Specifically, each part 51*a*, 51*b* comprises an activation means or device 57*a*, 57*b* in the form of a protrusion having a sharp proximal edge, and defines an exposure chamber 53*a*, 53*b*.

Further, each part 51*a*, 51*b* is adapted to accommodate an end portion of a strip-shaped analysis means or unit 55*a*, 55*b*. In the assembled state (FIG. 2), the half shells 81*a*, 81*b* define diametrically opposed elongate pockets for accommodating the analysis strip 55*a*, 55*b* so as to lead the analysis strip 55*a*, 55*b* from the analysis device 51*a*, 51*b* at the distal end of the half shells 81*a*, 81*b* towards the proximal end thereof. A fixing means or device 54*a*, 54*b* are provided for securely mounting the analysis strips 55*a*, 55*b* to the half shells 81*a*, 81*b*.

The inlet device 11 includes coupling pins 19 cooperating, in use of the apparatus, with coupling cutouts 79 formed at the proximal end of the basic device 71. The preparation container 31 also includes coupling pins 39 (not shown in FIG. 4) which are adapted to cooperate with coupling cutouts 79 formed at the distal end of the basic device 71.

The coupling pins 19 of the inlet device 11 and the coupling pins 39 of the preparation container 31 also serve as guiding pins 83 which, in use of the apparatus, are guided by guiding slots 85 formed in the half shells 81*a*, 81*b*. The basic device 71 includes guiding pins 83 as well.

The position, the shape and the size of the guiding slots 85 and the position of the guiding pins 83 are made such that the motion of the inlet device 11, the basic device 71 and the preparation container 31 inside the housing 91 is limited to a sequence of alternating rotational and axial movements which will be described in more detail with reference to FIGS. 5 to 8.

The outer surface of the basic device 71 includes a plurality of indications 74 corresponding to the different conditions of the apparatus which may be established in use of the apparatus. Depending on the condition and thus of the position and orientation of the basic device 71 inside the housing 91, a corresponding one of the indications 74 can be viewed by the user from outside the housing 91 through a window 94 formed in the housing 91 and through a window 84 formed in the respective half shell 81*b*. These indications and windows may be disposed at the opposite side of the apparatus as well.

Figure 3:
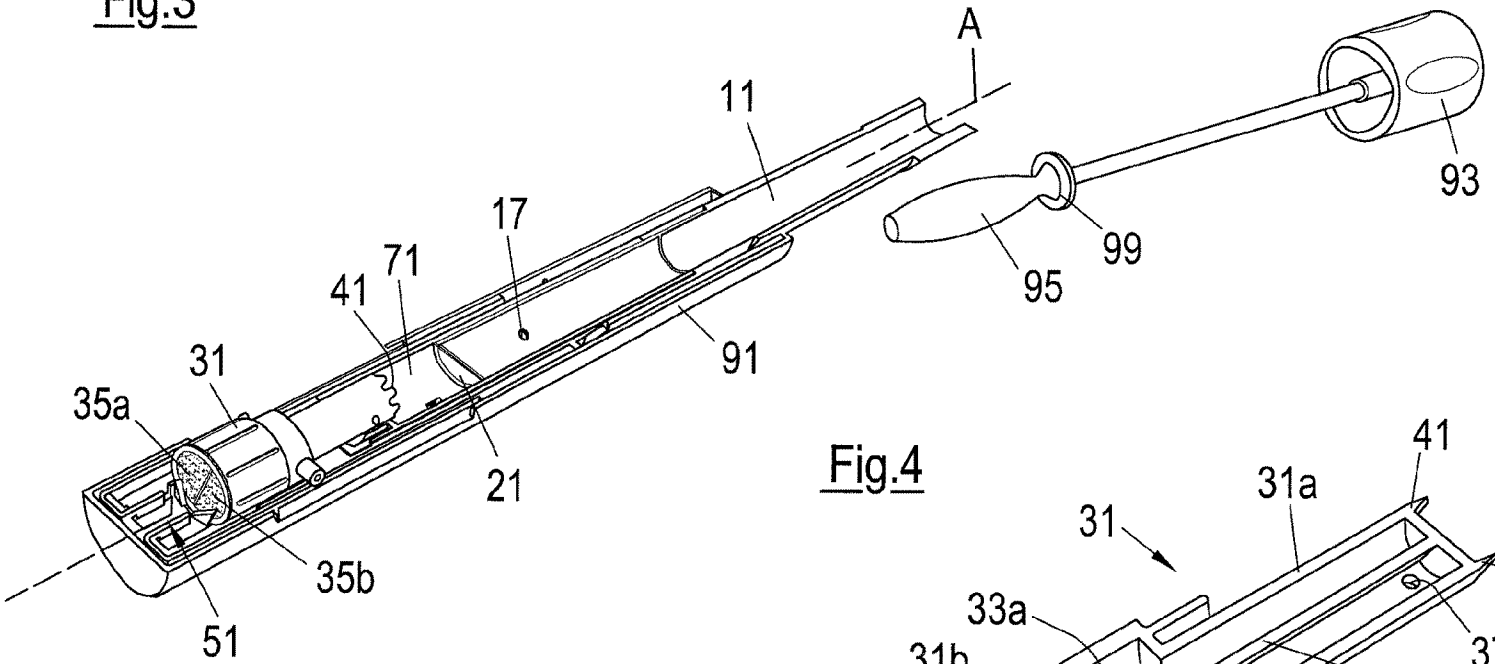
FIG. 3 shows a sectional view along the longitudinal axis of the apparatus of FIG. 1 with the sample collector being taken out of the housing.

As already mentioned before, the guiding device of the analyzing apparatus, which in this embodiment are in form of the half shells 81*a*, 81*b*, are designed so as to limit the motion of the individual devices 11, 71 and 31 to a sequence of alternating rotational and axial movements with respect to a longitudinal axis A of the analyzing device (FIG. 3). In order to provide resistance to the rotational movements of the devices 11, 71 and 31, which has to be overcome by the user, the boundaries of the guiding slots 85 are partially formed by elastically deformable lugs 86. A distal-most lug 86*a* of the slot 85 which is provided for the guiding pin 83 of the inlet device 11 may be designed such that the pin 83 of the inlet device 11 is locked at the distal end of the slot 85 when the inlet device 11 reaches its distal-most position inside the half shells 81*a*, 81*b* and thus inside the housing 91. This position of the inlet device corresponds to the analysis condition of the apparatus shown in FIG. 8.

Figure 4:
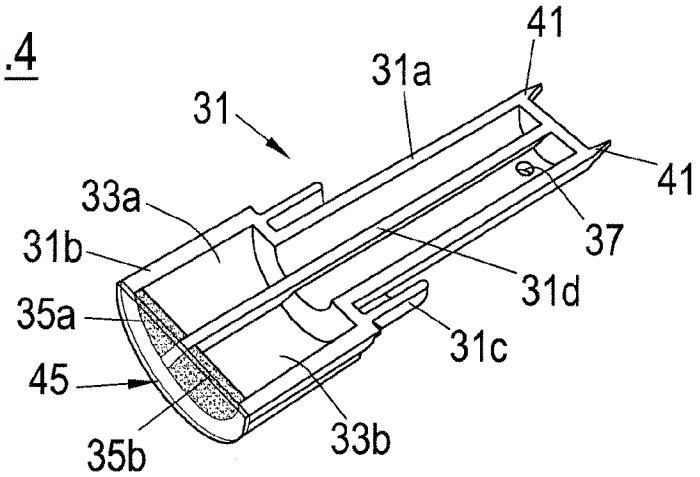
FIG. 4 shows a sectional view along the longitudinal axis of the preparation device of the analyzing apparatus of FIG. 1, and FIGS. 5 to 8 show sectional views of the analyzing apparatus of FIG. 1 in different states of use.

With reference to FIGS. 3 and 4, the preparation container 31, which constitutes a separate component of the analyzing apparatus, comprises a proximal cylindrical portion 31*a* having a first diameter and a distal cylindrical portion 31*b* having a second diameter, the first diameter being smaller than the second diameter. At the proximal end of the distal cylindrical portion 31*b*, a cylindrical stub 31*c* is formed which has a third diameter being larger than the first diameter and being smaller than the second diameter. This structure is adapted to mesh with a complementary structure formed at the distal end of the basic device 71 in use of the apparatus (FIGS. 5 to 8).

Inside the preparation container 31, a separation wall 31*d* extending in the axial direction divides the inner space of the preparation container 31 into two separate preparation chambers 33*a*, 33*b*. Each preparation chamber 33*a*, 33*b* is accessible for a fluid through a hole 37. Only one hole 37 is shown in FIG. 4.

The distal end of the preparation container 31 and thus of the two preparation chambers 33*a*, 33*b* is closed by a common breakable seal 45 in the form of a foil.

The proximal end of the preparation container 31 and thus of the preparation chambers 33*a*, 33*b* is closed. From the closed proximal end of the preparation container 31, several circumferentially spaced apart pointed protrusions 41 extend towards proximal. These protrusions 41 form an activation means or device adapted to break the seal 21 at the distal end of the inlet device 11 in use of the apparatus.

At its distal end, the preparation container 31 carries two semicircular preparation reagents 35*a*, 35*b* which are provided in the form of a solid body. Each preparation reagent 35*a*, 35*b* is associated with a respective one of the preparation chambers 33*a*, 33*b*. The preparation reagents 35*a*, 35*b* may be identical. In an alternative embodiment, the preparation reagents 35*a*, 35*b* may be different so as to provide different prepared test liquids.

In the embodiment described here, the analyzing apparatus can assume four different conditions illustrated in FIGS. 5 to 8.

Figure 5:
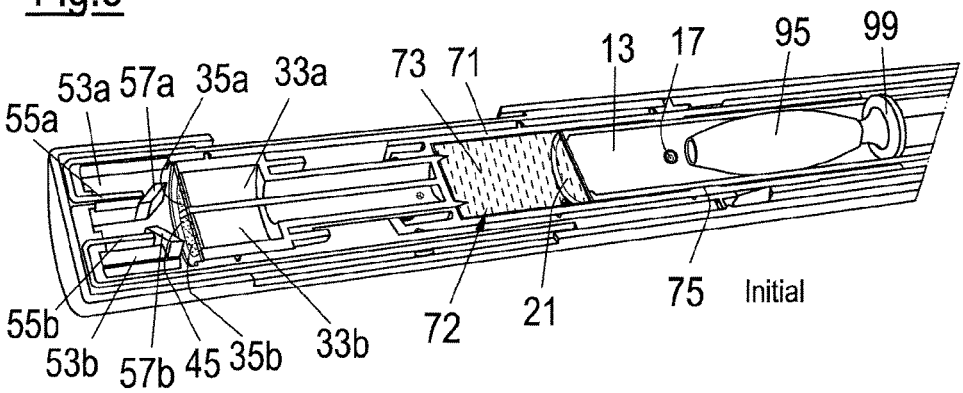

In an initial condition shown in FIG. 5, the apparatus is ready to receive the sample collector 95. The sample collector 95, which for example includes a salvia sample, is inserted into the proximal inlet opening of the inlet device 11. A predetermined insertion depth of the sample collector 95 is defined by the length of the elongate support 97. In the finally inserted state, the closure 93 is slid over the coupling portion 14 at the proximal end of the inlet device 11 (FIG. 2). The plug member 99 near the proximal end of the sample collector 95 closes the inlet chamber 13 of the inlet device 11 in a fluid-tight manner.

In the initial condition, the basic chamber 73 of the basic device 71 is already filled with a diluent acting as a basic fluid 72 for washing-out the sample collector 95 or for dissolving the sample which is introduced by the collector 95.

The cylindrical distal portion of the inlet device 11 is sealingly fitted into the basic device 71. A circumferential sealing shoulder 75 prevents leakage of the basic fluid 72 out of the basic chamber 73 into which the distal cylindrical portion of the inlet device 11 protrudes.

A hole 17 is formed in the wall of the inlet chamber 13 at an axial position corresponding to the axial position of the sealing shoulder 75 in the initial condition so that no fluid communication exists between the basic chamber 73 and the inlet chamber 13 in the initial condition.

The activation protrusions 41 of the preparation container 31 protrude into the basic chamber 73 but are still located in an axial distance from the seal 21 of the inlet device 11 in the initial condition. Further, in the initial condition the seal 45 of the preparation container 31 is still axially spaced apart from the activation protrusions 57*a*, 57*b* formed at the distal end portions of the half shells 81*a*, 81*b*.

Figure 6:
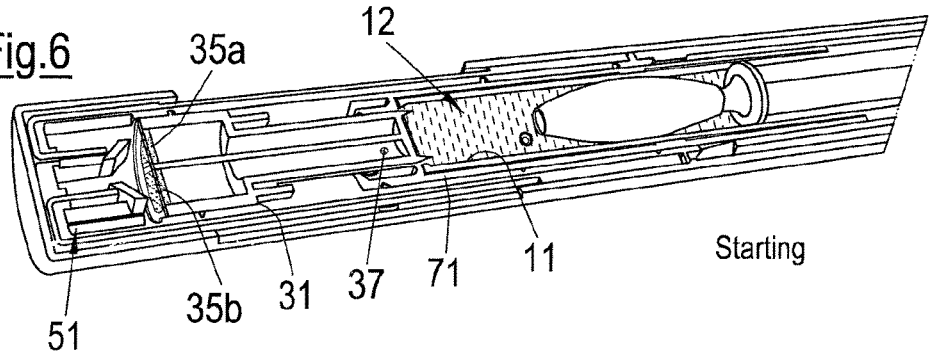

In order to change the condition of the apparatus from the initial condition to a starting condition as shown in FIG. 6, the user has to rotate the inlet device 11 via the closure 93. As controlled by the guiding half shells 81*a*, 81*b*, without such a rotational movement it is not possible to axially push the inlet device 11 further into the housing 91 so that without this rotational movement the starting condition of FIG. 6 cannot be established.

By pushing the inlet device 11 into the basic device 71, a fluid communication for the basic fluid 72 is established from the basic chamber 73 into the inlet chamber 13 through the hole 17. Consequently, in the starting condition the inlet chamber 13 is filled with the basic fluid 72 which enables a washing-out of the sample collector 95, thereby providing a test liquid 12 inside the inlet chamber 13. The salvia sample introduced into the apparatus by the sample collector 95 is thus dissolved in the basic fluid 72, so that the test liquid 12 contains the dissolved sample to be analyzed.

Further, in the starting condition of FIG. 6, the pins 19 at the inlet device 11 (FIG. 1) have entered the corresponding cutouts 79 at the proximal side of the basic device 71 so as to rotationally fixedly couple the inlet device 11 and the basic device 71 to each other.

Figure 7:
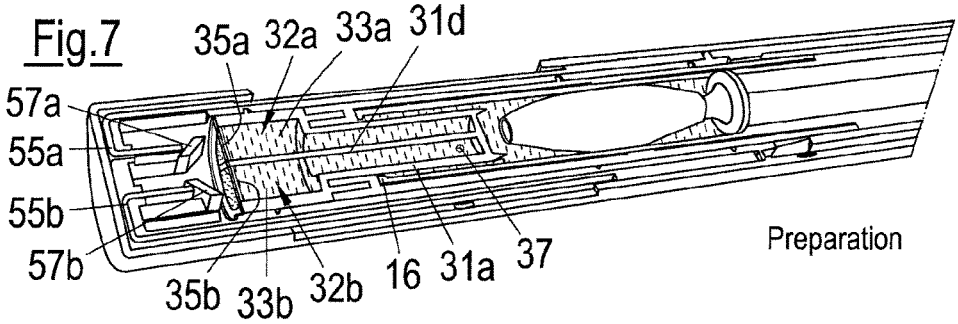

In order to actually analyze the sample dissolved in the test liquid 12, the test liquid 12 has to be prepared. In order to establish a preparation condition of the apparatus as shown in FIG. 7, the inlet device 11 and the basic device 71 are jointly rotated by the user via the closure 93 and then—again controlled by the guiding half shells 81*a*, 81—jointly pushed further into the housing 91 along the longitudinal axis A. An axial movement of the preparation container 31 is inhibited since the pins 39, 83 of the preparation container 31 (FIG. 2) are not yet aligned with the corresponding axial portion of the guiding slots 85.

When the inlet device 11 and the basic device 71 are jointly pushed into the preparation position, the proximal cylindrical portion 31*a* of the preparation container 31 slides into the inlet chamber 13, thereby breaking the seal 21 which is disposed at the distal end of the inlet device 11. In the starting position shown in FIG. 6, the activation protrusions 41 of the preparation container 31 already puncture the seal 21. However, since the proximal end of the preparation chambers 33*a*, 33*b* is closed, the test liquid 12 cannot flow into the preparation chambers 33*a*, 33*b* in the starting condition of the apparatus.

In the preparation condition, however, it is possible for the test liquid 12 to flow into the preparation chambers 33*a*, 33*b* through the holes 37.

Consequently, the test liquid 12 fills the preparation chambers 33*a*, 33*b*, thereby reacting with the preparation reagents 35*a*, 35*b* so as to establish—after a certain period of time, for example after waiting a few minutes—prepared test liquids 32*a*, 32*b* inside the preparation chambers 33*a*, 33*b*. The prepared test liquids 32*a*, 32*b* are completely separated from each other by the separation wall 31*d* inside the preparation container 31.

Consequently, by using different preparation reagents 35*a*, 35*b*, the analyzing apparatus as disclosed herein is able to provide two different prepared test liquids 32*a*, 32*b* at the same time so as to allow simultaneous analysis of the sample in two different ways. While in the embodiment described here, the apparatus includes two analysis functions which can be used simultaneously, in an alternative embodiment more than two concurrently usable analysis functions may be provided by dividing the preparation container 31 into e.g. three or four or even more preparation chambers, each preparation chamber being associated with a respective one of a corresponding number of preparation agents, exposure chambers and e.g. a strip-shaped analysis means or device. In other words, generally a plurality of parallel analysis paths being circumferentially distributed around the longitudinal axis may be disposed inside the housing 91.

Leakage of test liquid 12 out of the inlet chamber 13 past the proximal cylindrical portion 31*a* of the preparation device 31 is prevented by a circumferential sealing lip 16 formed at the distal end of the inlet device 11 on the inner wall thereof. Thus, when the inlet device 11 enters the preparation condition shown in FIG. 7, the proximal cylindrical portion 31*a* is sealingly fitted into the distal opening of the inlet device 11.

Further, in the preparation condition shown in FIG. 7, the coupling pins 39 of the preparation container 31 (FIG. 1) have entered the corresponding coupling cutouts 79 at the distal end of the basic device 71. Consequently, the inlet device 11, the basic device 71 and the preparation container 31 are now rotationally fixedly coupled to each other.

Figure 8:
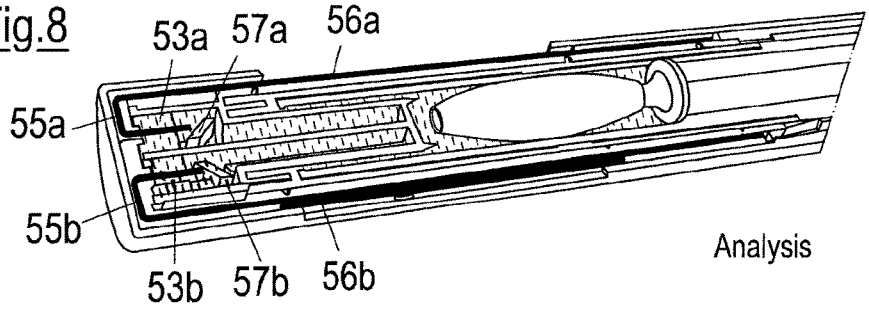

In order to establish an analysis condition of the apparatus as shown in FIG. 8, the inlet device 11 is further rotated by the user via the closure 93, thereby rotating also the basic device 71 and the preparation container 31. Following this rotational activation step, the inlet device 11, the basic device 71 and the preparation container 31 can be jointly pushed further into the housing 91, this change of condition being again controlled by the guiding half shells 81*a*, 81*b*.

When the preparation container 31 moves from the preparation position of FIG. 7 into the analysis position of FIG. 8, the activation protrusions 57*a*, 57*b* break the seal 45, thereby establishing a flow connection for the prepared test liquids 32*a*, 32*b* into a respective one of the exposure chambers 53*a*, 53*b*.

Figure 1:
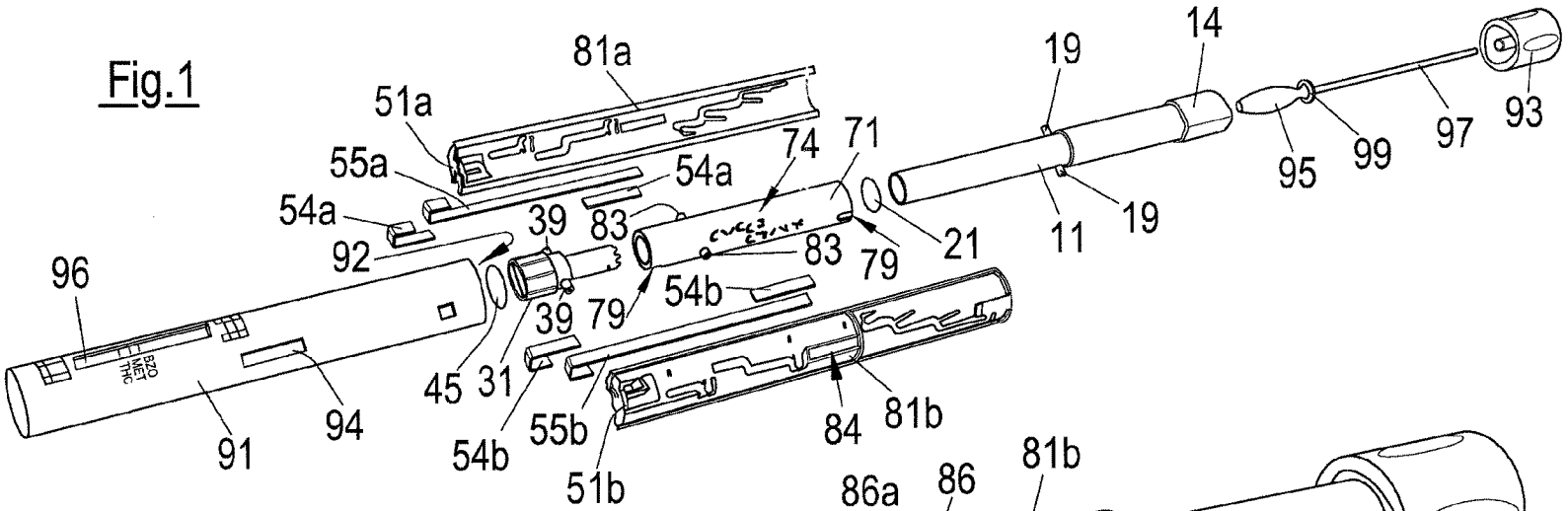
FIG. 1 shows an exploded view of an analyzing apparatus according to the present disclosure.

The end portions of the analysis strips 55*a*, 55*b*, which are arranged in the exposure chambers 53*a*, 53*b*, are thus exposed to a respective one of the prepared test liquids 32*a*, 32*b*. Consequently, each prepared test liquid 32*a*, 32*b* can flow through the respective analysis strip 55*a*, 55*b* resulting in exposed analysis strips 56*a*, 56*b* which can be viewed from outside the housing 91 through corresponding windows 96 (FIG. 1).

From the above description, the skilled person will easily appreciate that the analyzing apparatus as disclosed herein includes—amongst others—a guiding concept which ensures an easy and reliable operation of the apparatus by following a strict concept of subsequent rotational and axial movements of the individual components of the apparatus for establishing specific operational conditions thereof. Specifically, the apparatus as disclosed herein may be used for rapid chemical or drug tests but is not limited to this field of use.

The invention claimed is:

1. An apparatus for analyzing a test liquid, the apparatus comprising:

an inlet device defining at least one inlet chamber configured to receive the test liquid;

a preparation device defining at least one preparation chamber associated with the at least one inlet chamber and including at least one preparation reagent to be reacted with the test liquid for preparing the test liquid;

an analysis device defining at least one exposure chamber associated with the at least one preparation chamber and including an analysis unit to be exposed to the prepared test liquid for indicating information on the test liquid;

a housing defining a longitudinal axis and having a proximal end and a distal end, inside the housing, the inlet device being located proximal to the preparation device and the preparation device being located proximal to the analysis device, the inlet device being configured to be moved relative to the housing along the longitudinal axis towards the preparation device from a starting position, defining a starting condition of the apparatus, into a preparation position for establishing a flow connection for the test liquid from the at least one inlet chamber to the at least one preparation chamber in a preparation condition of the apparatus, and the inlet device and the preparation device being configured to be subsequently moved jointly relative to the housing along the longitudinal axis towards the analysis device from the preparation position into an analysis position for establishing a flow connection for the prepared test liquid from the at least one preparation chamber to the exposure chamber in an analysis condition of the apparatus; and a guiding device configured to guide at least one of the inlet device, the preparation device and the analysis device so as to limit the motion of at least one of the inlet device, the preparation device and the analysis device to a sequence of alternating rotational and axial movements, each axial movement of the at least one of the inlet device, the preparation device and the analysis device requiring activation through a preceding rotational movement of the at least one of the inlet device, the preparation device and the analysis device.

2. The apparatus according to claim 1, wherein a basic chamber is disposed inside the housing, the basic chamber containing or being configured to receive a basic fluid to be transferred into the at least one the inlet chamber of the inlet device, and an activation device is provided to establish a flow connection for the basic fluid from the basic chamber to the at least one inlet chamber before moving the inlet device towards the preparation device.

3. The apparatus according to claim 1, further comprising a basic device defining a basic chamber, the basic device being axially arranged between the inlet device and the preparation device, successively, the inlet device being configured to be moved from an initial position into the starting position, the inlet device and the basic device being configured to be jointly moved from the starting position into the preparation position, and the inlet device, the basic device and the preparation device being configured to be jointly moved from the preparation position into the analysis position.

4. The apparatus according to claim 3, wherein the inlet device, the basic device and the preparation device are configured to be successively nested into each other coaxially with respect to the longitudinal axis as the apparatus changes between the starting condition, the preparation condition and the analysis condition.

5. The apparatus according to claim 1, further comprising coupling devices that are associated with the inlet device and the preparation device, respectively with the basic device and the preparation device and that are configured to rotationally fixedly couple the inlet device and the preparation device, respectively the basic device and the preparation device to each other in a joined state, so as to effect activation of the axial movement of a distal one of the inlet device and the preparation device, respectively of the basic device and the preparation device through a rotational movement of a proximal one of the inlet devices and the preparation device, respectively of the basic device and the preparation device.

6. The apparatus according to claim 5, wherein the guiding device is configured to automatically control enabling of the coupling devices or the guiding device is configured to provide resistance to rotational movement of the at least one device, or the guiding device comprises at least one slot cooperating with at least one pin, or with at least one pin being formed at the at least one device and the slot being arranged stationary with respect to the housing.

7. The apparatus according to claim 1, further comprising a sample collector configured to be introduced into the at least one inlet chamber of the inlet device.

8. The apparatus according to claim 1, wherein the inlet device has a distal end defining a distal opening allowing enabling access to the at least one inlet chamber and being configured to receive the preparation device in the preparation position of the inlet device, or the preparation device includes an activation device configured to establish the flow connection for the test liquid from the at least one inlet chamber.

9. The apparatus according to claim 1, wherein, in the preparation position of the inlet device, the preparation device is sealingly fitted into the inlet device so as to locate the at least one preparation chamber within the at least one inlet chamber, or the preparation device has a wall confining the preparation chamber, the wall having a circumferential portion in which at least one hole is disposed so as to enable the test liquid to flow from the at least one inlet chamber through the hole into the preparation chamber.

10. The apparatus according to claim 1, wherein the preparation device comprises a separate container, including the at least one preparation chamber and the preparation reagent, the separate container being loaded or being configured to be loaded into the housing, or the preparation reagent is in the form of a solid body carried by the preparation device and being in fluidic contact with the at least one preparation chamber, or the preparation reagent is a fluid contained in the at least one preparation chamber.

11. The apparatus according to claim 1, wherein the preparation device has a distal end defining a distal opening allowing enabling access to the at least one preparation chamber and configured to receive, in the analysis position, the analysis device so as to expose the analysis unit inside the exposure chamber of the analysis device to the prepared test liquid contained in the at least one preparation chamber.

12. The apparatus according to claim 1, wherein the apparatus already contains a basic fluid and at least one preparation reagent, the basic fluid being contained in a basic chamber disposed inside the housing, and the preparation reagent being included in the at least one preparation chamber defined by the preparation device.

13. A preparation container for an apparatus according to claim 1, wherein the preparation device defines the at least one preparation chamber and includes the at least one preparation reagent, the preparation device being configured to be loaded into the housing of the apparatus so as to form the preparation device of the apparatus.

14. A method comprising:

operating the apparatus according to claim 1 for performing chemical rapid tests or drug rapid tests, by exposing the analysis unit, contained within the apparatus, to the test liquid or to a prepared test liquid obtained by reacting, inside the apparatus, the at least one preparation reagent, included within the apparatus, with the test liquid.

15. The apparatus according to claim 2, wherein the inlet device is configured to be moved relative to the housing along the longitudinal axis from an initial position, defining an initial condition of the apparatus, into the starting position, the activation device being configured to establish the flow connection for the basic fluid when the inlet device is in the starting position or is being moved towards the starting position.

16. The apparatus according to claim 3 wherein the guiding device is configured to guide the inlet device, the basic device and the preparation device.

17. The apparatus according to claim 4, wherein the inlet device is slidable into the basic device and the preparation device is slidable into the inlet device.

18. The apparatus according to claim 5, wherein the coupling devices are configured to be enabled by moving a respective proximal device along the longitudinal axis of the housing towards a respective distal device.

19. The apparatus according to claim 1, wherein the guiding device comprises at least one separate guide component.

20. The apparatus according to claim 19, wherein the housing has a wall, the at least one separate guide component being arranged inside the housing between the at least one device, the preparation device and the analysis device and the wall of the housing, thereby at least partially enclosing the at least one of the inlet device, the preparation device and the analysis device or the guide component comprises at least two parts, with at least the inlet device and the preparation device being received within a space defined by the at least two parts of the guide component, and the at least two parts of the guide component, the inlet device and the preparation device-forming a sub-assembly which is received within the housing and which, on assembly of the analyzing apparatus, is configured to be inserted into the housing.

21. The apparatus according to claim 19, wherein the guide component generally has the shape of a hollow cylinder enclosing at least one of the inlet device, the preparation device and the analysis device at least partially.

22. The apparatus in accordance with claim 20, wherein the sample collector is mounted at a distal end of an elongate support configured to be manually held by a user, or the sample collector comprises a plug member configured to be sealingly fitted into the inlet device so as to proximally close off the at least one inlet chamber in a fluid-tight manner.

23. The apparatus according to claim 10 wherein, in the preparation position of the preparation device, the distal opening is closed by a breakable seal, or the analysis device includes an activation device configured to activate the flow connection for the prepared test liquid from the at least one preparation chamber to the exposure chamber.

24. The preparation chamber according to claim 12, wherein the preparation reagent is in the form of a solid body carried by the preparation device and in fluidic contact with the at least one preparation chamber, or the preparation reagent is a fluid contained in the at least one preparation chamber.

25. A method according to claim 13, wherein the test liquid is filled into the apparatus or is obtained by introducing a test sample into the apparatus and dissolving or mixing, inside the apparatus, the test sample in or with a basic fluid contained within the apparatus.

* * * * *